US008460063B2

(12) United States Patent
Suzuki

(10) Patent No.: US 8,460,063 B2
(45) Date of Patent: Jun. 11, 2013

(54) POLISHING APPARATUS

(75) Inventor: Yuji Suzuki, Kariya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 287 days.

(21) Appl. No.: 12/919,642

(22) PCT Filed: Feb. 4, 2009

(86) PCT No.: PCT/IB2009/000289
§ 371 (c)(1),
(2), (4) Date: Aug. 26, 2010

(87) PCT Pub. No.: WO2009/106948
PCT Pub. Date: Sep. 3, 2009

(65) Prior Publication Data

US 2011/0009037 A1 Jan. 13, 2011

(30) Foreign Application Priority Data

Feb. 27, 2008 (JP) ..... 2008-046248

(51) Int. Cl.
*B24B 9/04* (2006.01)
*B24D 13/14* (2006.01)

(52) U.S. Cl.
USPC ..... 451/51; 451/44; 451/283

(58) Field of Classification Search
USPC ..... 451/51, 283, 285, 44
IPC ..... B24B 29/00,29/02, 13/00
See application file for complete search history.

(56) References Cited

U.S. PATENT DOCUMENTS

| | | | | |
|---|---|---|---|---|
| 1,461,514 | A * | 7/1923 | Burns | 451/548 |
| 1,525,225 | A * | 2/1925 | Chase | 15/230.16 |
| 1,611,352 | A * | 12/1926 | Larsson | 451/548 |
| 2,867,063 | A * | 1/1959 | Metzger | 451/548 |
| 3,171,237 | A * | 3/1965 | Howard | 451/548 |
| 4,760,668 | A * | 8/1988 | Schlaefli | 451/56 |
| 4,961,290 | A * | 10/1990 | Hawkes et al. | 451/550 |
| 5,607,341 | A * | 3/1997 | Leach | 451/41 |
| 6,966,826 | B2 * | 11/2005 | Suzuki et al. | 451/450 |
| 6,986,703 | B2 * | 1/2006 | Weber | 451/285 |
| 7,413,496 | B2 * | 8/2008 | Yoshimura et al. | 451/5 |
| 7,500,905 | B2 * | 3/2009 | Iga | 451/57 |
| 2001/0011004 | A1 * | 8/2001 | Yamaguchi et al. | 451/548 |
| 2006/0009134 | A1 * | 1/2006 | Katayama | 451/41 |
| 2006/0211343 | A1 * | 9/2006 | Yoshimura et al. | 451/51 |
| 2007/0032177 | A1 * | 2/2007 | Park | 451/57 |
| 2007/0271718 | A1 | 11/2007 | Hettes | |
| 2008/0064304 | A1 * | 3/2008 | Iga | 451/57 |

FOREIGN PATENT DOCUMENTS

| | | |
|---|---|---|
| JP | 62-085360 U | 5/1987 |
| JP | 62-162475 A | 7/1987 |

(Continued)

OTHER PUBLICATIONS

Office Action issued Mar. 1, 2012 in CN 200980106741.5 and English translation thereof.

*Primary Examiner* — Lee D Wilson
*Assistant Examiner* — Tyrone V Hall, Jr.
(74) *Attorney, Agent, or Firm* — Kenyon & Kenyon LLP

(57) ABSTRACT

A polishing apparatus for polishing an end edge of a work piece by bringing a bristle tip of a polishing brush into contact with the end edge of the work piece as the bristle tip passes the end edge of the work piece includes a support plate having a through hole into which the polishing brush is inserted and a suppression portion that is provided at the support plate and suppresses a deformation of the bristle tip of the polishing brush when the work piece is polished.

12 Claims, 7 Drawing Sheets

FOREIGN PATENT DOCUMENTS

| | | | | |
|---|---|---|---|---|
| JP | 05208357 | A | * | 8/1993 |
| JP | 08317608 | A | * | 11/1996 |
| JP | 10-058295 | A | | 3/1998 |
| JP | 10058295 | A | * | 3/1998 |
| JP | 2001-205569 | A | | 7/2001 |
| JP | 2004-261882 | A | | 9/2004 |
| JP | 2005-254339 | A | | 9/2005 |
| JP | 2005254339 | A | * | 9/2005 |

* cited by examiner

POLISHING APPARATUS

This is a 371 national phase application of PCT/IB2009/000289 filed 4 Feb. 2009, claiming priority to Japanese Patent Application No. 2008-046248 filed 27 Feb. 2008, the contents of which are incorporated herein by reference.

BACKGROUND OF THE INVENTION

1. Field of the Invention

The invention relates to a polishing apparatus for polishing a work piece, for example the end edge of a metal ring for a power transmission belt employed in a belt type continuously variable transmission.

2. Description of the Related Art

A vehicle is typically installed with an automatic transmission that adjusts a transmission gear ratio in accordance with a traveling condition of the vehicle. A belt type continuously variable transmission (CVT) that adjusts the gear ratio steplessly may be installed as the automatic transmission.

A CVT is capable of transmitting engine output efficiently and achieves improvements in fuel efficiency and traveling performance. The CVT uses a power transmission belt and a pair of pulleys, for example, to realize stepless shifts continuously by varying an effective diameter of the pulleys hydraulically. The power transmission belt is looped around an input side pulley attached to an input shaft and an output side pulley attached to an output shaft. By varying a groove width of the input side pulley and output side pulley, a loop radius of the power transmission belt relative to the input side pulley and output side pulley varies, and as a result, a rotation speed ratio between the input shaft and the output shaft, or in other words the gear ratio, can be varied continuously and steplessly.

The power transmission belt is formed by preparing a plurality of elements with varying thickness and passing stacked metal rings through the plurality of elements. A high degree of dimensional precision is required in the metal rings of the power transmission belt. More specifically, the metal ring is formed by cutting a cylindrical drum, which is formed by welding the end portions of super-strength steel thin plates together, into predetermined widths. Following cutting, the end edge of the metal ring is sharp, and therefore finishing is required to polish the end edge into a highly precise curved shape.

A polishing apparatus of a related art field for polishing an end edge of a metal ring will now be described on the basis of FIGS. 9 to 11 and with reference to FIG. 1. As shown in FIG. 1, a polishing device 50 includes a ring rotation device (not shown) that holds a metal ring 2 and rotates the metal ring 2 in a circumferential direction, a columnar polishing brush 3 that polishes an end edge 22 of the metal ring 2 by bringing bristle tips thereof into contact with the end edge 12 as the bristle tips pass the end edge 12, a holding plate 4 on which a plurality of the polishing brushes 3 stand upright at intervals in a circumferential direction and which holds one end portion of each polishing brush 3, and a support plate 6 having through holes 5 into which the polishing brushes 3 are respectively inserted, for adjusting a bristle length of the polishing brushes 3 extending from the through holes 5 and suppressing splaying of the polishing brushes 3. Note that the polishing apparatus 50 according to the related art field is provided with two polishing brush units 10, each of which is constituted by the polishing brushes 3, the holding plate 4, and the support plate 6, and these two polishing brush units 10 are disposed in close proximity.

The polishing brush 3 is formed by bundling together a plurality of bristles constituted by resin wires containing a polishing material into a columnar shape. One end portion of each polishing brush 3 is fixed to an outer peripheral portion of the holding plate 4 such that the polishing brushes 3 are disposed at intervals in a circumferential direction. The holding plate 4 is formed in a disc shape, and a rotary shaft (not shown) is provided in the center of the holding plate 4. Further, a motor (not shown) is connected to the rotary shaft so that the holding plate 4 can be driven to rotate by driving the motor. As a result, when the holding plate 4 is rotated, the polishing brushes 3 revolve.

As shown in FIGS. 1 and 9, the support plate 6 is formed in a disc shape having a substantially identical diameter to the holding plate 4. The through holes 5 into which the polishing brushes 3 are respectively inserted are formed on an outer peripheral portion of the support plate 6 in positions corresponding to the polishing brushes 3. Note that in FIG. 1, eight polishing brushes 3 are provided, whereas in FIG. 9, sixteen through holes 5 are formed in the support plate 6 for the polishing brushes 3. The reason for this difference is that FIG. 1 is a schematic diagram, and in actuality, the number of polishing brushes 3 matches the number of through holes 5 in the support plate 6. Further, as shown in FIG. 9, a large-diameter insertion hole 11 formed in the center of the support plate 6 and a plurality of (four in FIG. 9) small-diameter insertion holes 12 formed around the large-diameter insertion hole 11 are provided for fixing an elevator rod. Furthermore, a plurality of (eight in FIG. 9) insertion holes 13 are formed on the inside of the through holes 5 for the polishing brushes 3 at intervals in a circumferential direction to fix a plurality of guide rods. When the elevator rod is driven, the support plate 6 is capable of moving in the axial direction of the polishing brushes 3 and can be fixed in a predetermined position.

To polish the end edge 22 of the metal ring 2 using the polishing apparatus 50 according to the related art field, first, the metal ring 2 is attached to the ring rotation device such that the metal ring 2 straddles a part of the two polishing brush units 10, 10 and the end edge 12 thereof opposes the bristle tips of the polishing brushes 3. At the same time, the support plate 6 of each polishing brush unit 10 is moved to the bristle tip side of the polishing brushes 3 and fixed into position such that the bristle tips of the polishing brushes 3 project from the respective through holes 5 in the support plate 6 by approximately 5 mm to 20 mm. Note that the end edge 22 of the metal ring 2 and the bristle tips of the polishing brush 3 are disposed with an overlap by approximately 1 mm. The ring rotation device and the holding plate 4 are then driven to rotate, whereby the metal ring 2 rotates in a circumferential direction (a direction indicated by an arrow in FIG. 1: a counter-clockwise direction), and the respective holding plates 4 of the polishing brush units 10 rotate (in a direction indicated by an arrow in FIG. 1: a clockwise direction) such that the polishing brushes 3 revolve. Thus, as shown in FIG. 11B, the bristle tips of each polishing brush 3 contact the end edge 22 of the metal ring 2 while passing the end edge 12, and as a result, the end edge 22 of the metal ring 2 is polished to a predetermined curvature.

As shown in FIGS. 10 and 11, however, when the end edge 22 of the metal ring 2 is polished by the polishing brushes 3 of this polishing apparatus 50, the bristle tips of the polishing brush 3 deform so as to splay to the left and right sides of an advancement direction (the sites indicated by broken lines in FIG. 10), and also deform diagonally rearward in the advancement direction (the site indicated by a broken line in FIG. 11). When the polishing process is continued with the bristle tips of the polishing brush 3 in this deformed state, stress is concentrated in a single site of the bristle tips, leading to partial wear and a reduction in the durability of the polishing brush 3. Moreover, when the bristle tips of the polishing brush 3 deform such that partial wear occurs, a contact area between the bristle tips and the end edge 22 of the metal ring 2 deviates from the contact area at the start of the polishing, and as a result, an R shape of the end edge 22 of the metal ring 2 becomes unstable. Furthermore, when the bristle tips of the polishing brush 3 deform so as to splay, a phenomenon whereby the bent bristle tips strike a side face and so on of the metal ring 2 occurs, and as a result, this part is damaged, leading to a reduction in the strength of the metal ring 2.

In Japanese Patent Application Publication No. 2005-254339 (JP-A-2005-254339), which serves as related art proposed to solve the problems described above, a polishing apparatus includes: a ring holding portion for holding a metal ring in a circular form such that one end edge thereof is exposed; a ring rotating portion for rotating the metal ring in a circumferential direction via the ring holding portion; a brush holding portion for holding a polishing brush formed by bundling together a plurality of wires into a columnar shape so that the polishing brush can rotate using a longitudinal direction of a bristle base of the polishing brush as an axis; and a brush moving portion for moving the polishing brush to traverse a rotary track of the metal ring held by the ring holding portion via the brush holding portion and polishing the metal ring by bringing the polishing brush into contact with one end edge of the metal ring. When the metal ring is polished by the polishing apparatus, the polishing brush spins in accompaniment with the rotation of the metal ring upon contact with the metal ring, and therefore the part of the polishing brush that contacts the metal ring is always different. As a result, partial wear of the polishing brush can be reduced, and curling of the bristles can be prevented.

With the invention of JP-A-2005-254339, an attempt is made to reduce partial wear of the polishing brush by making the polishing brush capable of spinning. However, during polishing, the bristle tips of the polishing brush bend away from the metal ring, and therefore deformation of the polishing brush cannot be suppressed. Hence, the basic problem is not solved.

SUMMARY OF THE INVENTION

The invention provides a polishing apparatus capable of suppressing deformation of the bristle tips of a polishing brush when an end edge of a work piece is polished, whereby the durability of the polishing brush can be improved and a high degree of polishing precision can be maintained on the end edge of the work piece.

A first aspect of the invention relates to a polishing apparatus for polishing an end edge of a work piece by bringing a bristle tip of a polishing brush into contact with the end edge of the work piece as the bristle tip passes the end edge of the work piece. The polishing apparatus includes a suppression portion that suppresses a deformation of the bristle tip of the polishing brush when the work piece is polished, and the suppression portion is provided with a portion in which a height on left and right sides of an advancement direction of the polishing brush is greater than a height on front and rear sides of the advancement direction of the polishing brush. A second aspect of the invention relates to a polishing apparatus for polishing an end edge of a work piece by bringing a bristle tip of a polishing brush into contact with the end edge of the work piece, as the bristle tip passes the end edge of the work piece. In this polishing apparatus, the polishing brush is constituted such that on an orthoaxial cross-section of the polishing brush, a rigidity of bristle groups on left and right sides of an advancement direction of the polishing brush is greater than a rigidity of a substantially central bristle group. According to the aspects described above, deformation of the bristle tips of the polishing brush can be suppressed when the end edge of the work piece is polished, and as a result, the durability of the polishing brush can be improved and a high degree of polishing, precision can be maintained on the end edge of the work piece.

In the first aspect described above, the suppression portion may be constituted by wall portions that stand upright respectively from one side face of the support plate on left and right sides of the through hole in the advancement direction of the polishing brush. According to this constitution, splaying of the bristle tips of the polishing brush to the left and right sides of the advancement direction is restricted by the wall portions when the end edge of the work piece is polished, and as a result, deformation of the bristle tips of the polishing brush is suppressed.

In the first aspect described above, the through hole of the suppression portion may be formed such that a height of an inner wall surface on the left and right sides of the advancement direction of the polishing brush is greater than the height of the inner wall surface on the front and rear sides of the advancement direction of the polishing brush. According to this constitution, a restraining force applied to bristle groups on the left and right sides of the advancement direction of the polishing brush is improved. As a result, diagonally rearward splaying of the bristle tips of the polishing brush from the left and right sides of the advancement direction is restricted when the end edge of the work piece is polished, and therefore deformation of the bristle tips of the polishing brush is suppressed.

In the first aspect described above, the polishing brush may have a substantially rectangular orthoaxial cross-section, and the polishing brush may be disposed such that a thickness thereof in the advancement direction of the polishing brush is substantially constant. According to this constitution, the orthoaxial cross-section of the polishing brush is substantially rectangular, and the polishing brush is disposed such that the thickness thereof in the advancement direction is substantially constant, and therefore, during polishing of the end edge of the work piece by the polishing brush, the restraining force applied to the bristle groups on the left and right sides of the advancement direction of the polishing brush is improved in comparison with the restraining force applied to the bristle groups on the left and right sides of the advancement direction of a polishing brush having a circular orthoaxial cross-section.

In the first aspect described above, the suppression portion may include wall portions that stand upright respectively from one side face of the support plate on the left and right sides of the through hole in the advancement direction of the polishing brush, and in the suppression portion, the through hole may be formed such that a height of an inner wall surface on the left and right sides of the advancement direction of the polishing brush is greater than the height of the inner wall surface on the front and rear sides of the advancement direction of the polishing brush. According to this constitution, the wall portions provided on one side face of the support plate on the left and right sides of the through hole in the advancement direction of the polishing brush mainly restrict splaying of the bristle tips of the polishing brush to the left and right sides of the advancement direction, and the through hole of the support plate is formed such that the height of the inner wall surface on the left and right sides of the advancement direction of the polishing brush is greater than the height of the inner wall surface on the front and rear sides of the advancement direction. Hence, the restraining force applied to the bristle groups on the left and right sides of the advancement direction of the polishing brush is improved and diagonally rearward splaying of the bristle tips of the polishing brush from the left and right sides of the advancement direction is restricted. As a result, deformation of the bristle tips of the polishing brush is suppressed.

In the second aspect described above, the regional rigidity of the polishing brush may be set according to a material of a bristle unit of the polishing brush. Further, in the second aspect, a bristle unit of the polishing brush may have a substantially circular orthoaxial cross-section, and the regional rigidity of the polishing brush may be set according to an outer diameter of the bristle unit of the polishing brush. Furthermore, in the second aspect, the regional rigidity of the polishing brush may be set according to an orthoaxial sectional shape of a bristle unit of the polishing brush. According to these constitutions, the restraining force applied to the bristle groups on the left and right sides of the advancement direction of the polishing brush is improved, and therefore diagonally rearward splaying of the bristle tips of the polishing brush from the left and right sides of the advancement direction is restricted when the end edge of the work piece is polished. As a result, deformation of the bristle tips of the polishing brush is suppressed.

In the first and second aspects described above, the work piece may be a metal ring of a power transmission belt employed in a CVT. According to this constitution, the invention is particularly effective when used to polish the end edge of a metal ring for a power transmission belt employed in a CVT.

According to the invention, it is possible to provide a polishing apparatus with which deformation of the bristle tips of a polishing brush can be suppressed when an end edge of a work piece is polished, whereby the durability of the polishing brush can be improved and a high degree of polishing precision can be maintained on the end edge of the work piece.

BRIEF DESCRIPTION OF THE DRAWINGS

The foregoing and further features and advantages of the invention will become apparent from the following description of example embodiments with reference to the accompanying drawings, wherein like numerals are used to represent like elements, and wherein.

DETAILED DESCRIPTION OF EMBODIMENTS

Figure 1:
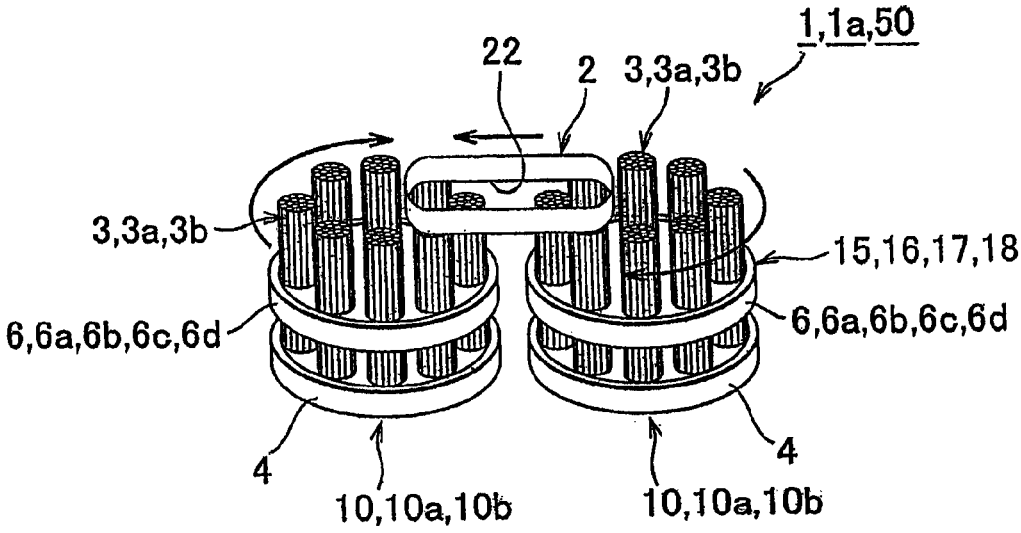
FIG. 1 is a schematic diagram showing a polishing apparatus according to an embodiment of the invention.

Embodiments of the invention will be described in detail below on the basis of FIGS. 1 to 8. A polishing apparatus 1 according to a first embodiment of the invention is used to polish a work piece, for example an end edge 22 of a metal ring 2 used in a power transmission belt of a CVT, into a predetermined R shape, and includes a ring rotation device (not shown) that holds the metal ring 2 and rotates the metal ring 2 in a circumferential direction, columnar polishing brushes 3, 3*a* that polish the end edge 22 of the metal ring 2 by bringing bristle tips thereof into contact with the end edge 22 as the bristle tips pass the end edge 22, a holding plate 4 on which a plurality of the polishing brushes 3, 3*a* stand upright at intervals in a circumferential direction and which holds one end portion of each polishing brush 3, 3*a*, and a suppression portion 15 to 18 for suppressing deformation of the bristle tips of the respective polishing brushes 3, 3*a* when the end edge 22 of the metal ring 2 is polished. Here, the polishing apparatus 1 is provided with two polishing brush units 10*a*, each of which is constituted by the polishing brushes 3, 3*a*, the holding plate 4, and the suppression portion 15 to 18, and these polishing brush units 10*a* are disposed in close proximity. Note that the ring rotation device and the holding plate 4 are identical to those of the conventional example, and hence description thereof has been omitted.

Figure 2:
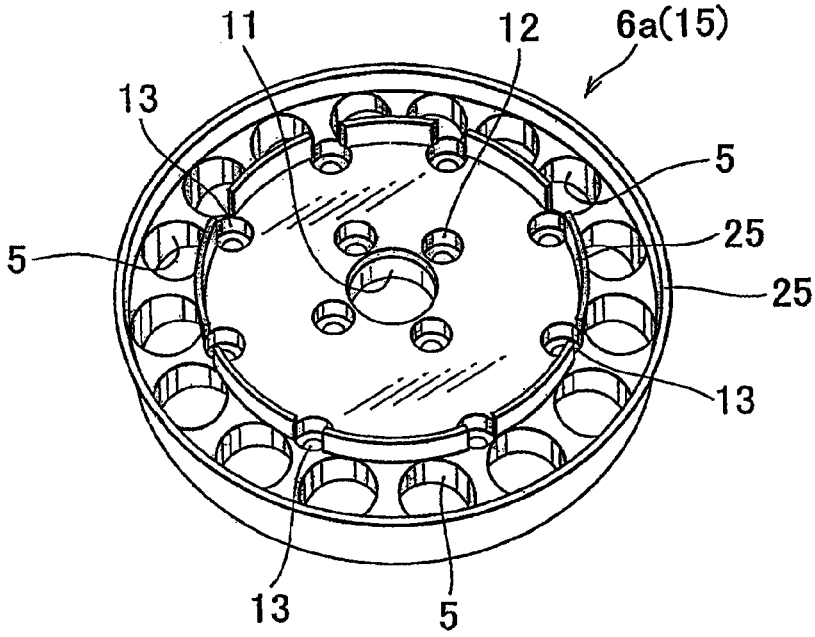
FIG. 2 is a perspective view showing a suppression portion employed in a polishing apparatus according to a first embodiment of the invention.

Next, a suppression portion 15 according to the first embodiment will be described on the basis of FIGS. 1 and 2. The suppression portion 15 according to the first embodiment is constituted by a support plate 6*a* provided with a plurality of through holes 5 into which the columnar polishing brushes 3 are inserted, for adjusting a bristle length of the polishing brushes 3 extending from the through holes 5 and suppressing splaying of the polishing brushes 3, and wall portions 25 that stand upright from one side face of the support plate 6*a* on the left and right sides of the through holes 5 in an advancement direction of the polishing brush 3.

The support plate 6*a* is formed in a disc shape having a substantially identical diameter to the holding plate 4. Further, the through holes 5 into which the plurality of polishing brushes 3 extending from the holding plate 4 are inserted are formed on an outer peripheral part of the support plate 6*a* in positions corresponding respectively to the polishing brushes 3. Further, as shown in FIG. 2, a large-diameter insertion hole 11 formed in the center of the support plate 6*a* and a plurality of (four in FIG. 2) small-diameter insertion holes 12 formed around the large-diameter insertion hole 11 are provided for fixing an elevator rod. Furthermore, a plurality of (eight in FIG. 2) insertion holes 13 are formed on an inner peripheral side of the through holes 5 at intervals in a circumferential direction to fix a plurality of guide rods. When the elevator rod is driven, the support plate 6*a* is capable of moving in the axial direction of the polishing brushes 3 and can be fixed in a predetermined position.

The wall portions 25 respectively stand upright on the left and right sides of the advancement direction of the polishing brush 3 such that one side face of each wall portion 25 forms a continuation of an inner wall face of the through holes 5 on the left and right sides of the advancement direction. Further, the wall portion 25 on the inner peripheral side of the through holes 5 extends in a discontinuous arc shape to avoid the insertion holes 13 for fixing the guide rods. The wall portion 25 on the outer peripheral side of the through holes 5, on the other hand, extends in a circular shape around an outer peripheral edge of the support plate 6*a*. Note that in the first embodiment, the height of each wall portion 25 is set at approximately 2 mm to 5 mm from one end side of the support plate 6*a*.

An action of the polishing apparatus 1 employing the suppression portion 15 according to the first embodiment will now be described. To polish the end edge 22 of the metal ring 2 using the polishing apparatus 1, first, the metal ring 2 is attached to the ring rotation device such that the metal ring 2 straddles a part of the two polishing brush units 10*a*, 10*a* and the end edge 22 thereof faces the bristle tips of the polishing brushes 3. At the same time, the support plate 6*a* of each polishing brush unit 10*a* is moved to the bristle tip side of the polishing brushes 3 and fixed into position such that the bristle tips of the polishing brushes 3 project from the respective through holes 5 in the support plate 6*a* by approximately 5 mm to 20 mm. Note that the end edge 22 of the metal ring 2 and the bristle tips of the polishing brush 3 are disposed with an overlap of approximately 1 mm.

The ring rotation device and the holding plate 4 are then driven to rotate, whereby the metal ring 2 is rotated in the circumferential direction (a direction indicated by an arrow in FIG. 1: a counter-clockwise direction), and the respective holding plates 4 of the polishing brush units 10*a* rotate (in a direction indicated by an arrow in FIG. 1: a clockwise direction) such that the polishing brushes 3 revolve. Thus, the polishing brush 3 contacts the end edge 22 of the metal ring 2 while passing the end edge 22, and as a result, the end edge 22 of the metal ring 2 is polished to a predetermined curvature. During polishing, splaying of the bristle tips of the polishing brush 3 to the left and right sides of the advancement direction is restricted by the wall portions 25 provided on the support plate 6*a* of the suppression portion 15 according to the first embodiment. As a result, deformation of the bristle tips of the polishing brush 3 is suppressed and partial wear of the bristle tips is prevented.

Next, a suppression portion 16 according to a first modified example of the first embodiment will be described on the basis of FIGS. 1, 3 and 4. The suppression portion 16 according to this modified example includes a support plate 6*b* provided with a plurality of through holes 5*a* into which columnar polishing brushes 3 are inserted, for adjusting the bristle length of the polishing brushes 3 extending from the through holes 5*a* and suppressing splaying of the polishing brushes 3, wherein the through holes 5*a* provided in the support plate 6*b* are respectively formed such that the height of an inner wall surface thereof on the left and right sides of the advancement direction of the polishing brush 3 is higher than the height of the inner wall surface on the front and rear sides of the advancement direction. Note that in this modified example, a difference between the highest end portion and the lowest end portion of the inner wall surface of each through hole 5*a* is set at approximately 2 mm to 5 mm.

Figure 3:
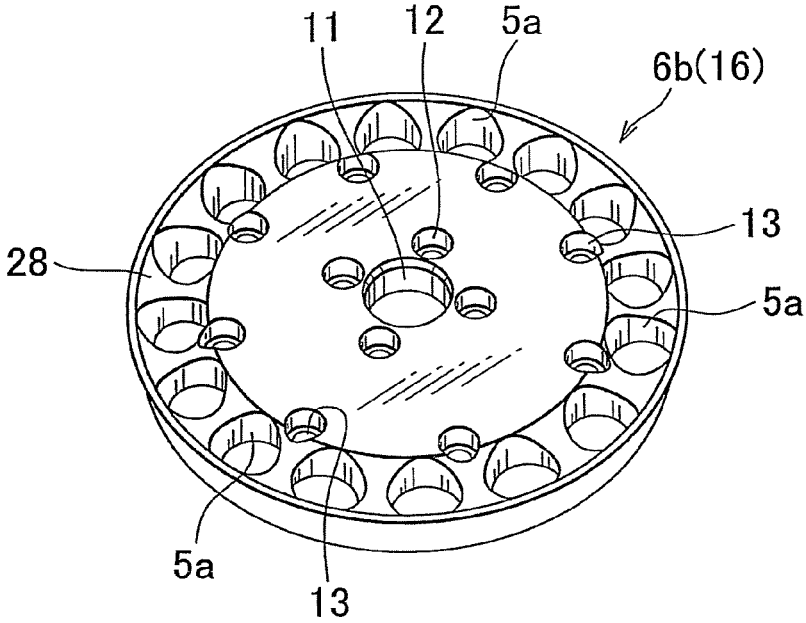
FIG. 3 is a perspective view showing a first modified example of the suppression portion employed in the polishing apparatus according to the first embodiment of the invention.
Figure 4:
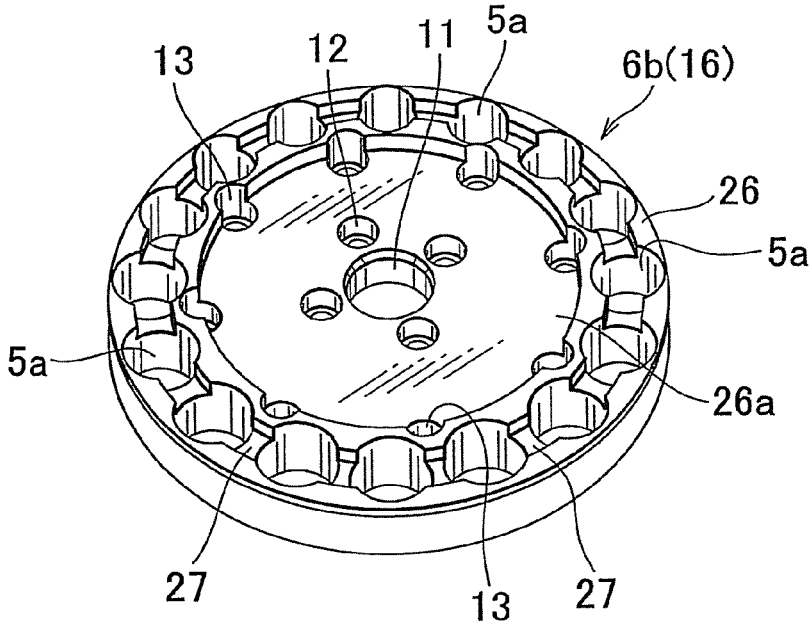
FIG. 4 is a perspective view showing a second modified example of the suppression portion employed in the polishing apparatus according to the first embodiment of the invention.

As shown in FIG. 3, a recess portion 28 is formed in the suppression portion 16 according to the first modified example of the first embodiment around the formation site of the through holes 5*a* (in a circumferential direction), and a diametrical direction cross-section of the recess portion 28 is formed in an arc shape. As a result, the through holes 5*a* are formed such that the inner wall surface height thereof on the left and right sides of the advancement direction of the polishing brush 3 is greater than the inner wall surface height on the front and rear sides of the advancement direction. Further, in a suppression portion 16 according to a second modified example of the first embodiment, as shown in FIG. 4, an outer peripheral site 26 of the support plate 6*b* in which the through holes 5*a* are formed projects to the metal ring 2 side, and the outer peripheral site 26 is formed to be thicker than the thickness of a central site 26*a*. In the outer peripheral site 26, groove portions 27 having a substantially rectangular diametrical direction cross-section are formed respectively in the wall portions between adjacent through holes 5*a*, 5*a*. As a result, the through holes 5*a* are formed respectively such that the inner wall surface height thereof on the left and right sides of the advancement direction of the polishing brush 3 is greater than the inner wall surface height on the front and rear sides of the advancement direction.

The support plate 6*b* of the suppression portion 16 according to the first and second modified examples is formed by removing the wall portions 25 from the support plate 6*a* of the suppression portion 15 according to the first embodiment and providing the through holes 5*a* in the manner described above. All other constitutions are similar to those of the support plate 6*a* of the suppression portion 15 according to the first embodiment.

Actions of the polishing apparatus 1 employing the suppression portion 16 according to the first and second modified examples will now be described. Note that processes up to the start of the process to polish the end edge 22 of the metal ring 2 using the polishing brushes 3 are identical to those of the polishing apparatus 1 employing the suppression portion 15 according to the first embodiment, and therefore description of these processes has been omitted. In the suppression portion 16 according to the first and second modified examples, when the support plate 6*b* is fixed to each polishing brush 3 at a predetermined position in the axial direction of the polishing brush 3, the length of a portion of the bristle tip in each of bristle groups on the right and left sides in the advancement direction of the polishing brush 3 (refer to the reference numeral 30 in FIG. 8), the portion protruding from the through hole 5*a* of the support plate 6*b*, is shorter than the length of a portion of the bristle tip in the substantially central group (refer to the reference numeral 31 in FIG. 8), the portion protruding from the through hole 5*a*. Thus, it is possible to increase a restraining force that is applied to the bristle tips in the bristle groups on the right and left sides in the advancement direction of the polishing brush 3 when the end edge 22 of the metal ring 2 is polished by the polishing brush 3. Therefore, it is possible to restrict diagonally rearward splaying the bristle tips in the groups on the right and left side in the advancement direction of the polishing brush 3. As a result, deformation of the bristle tips of the polishing brush 3 is suppressed and uneven wear of the bristle tips is prevented.

Figure 5:
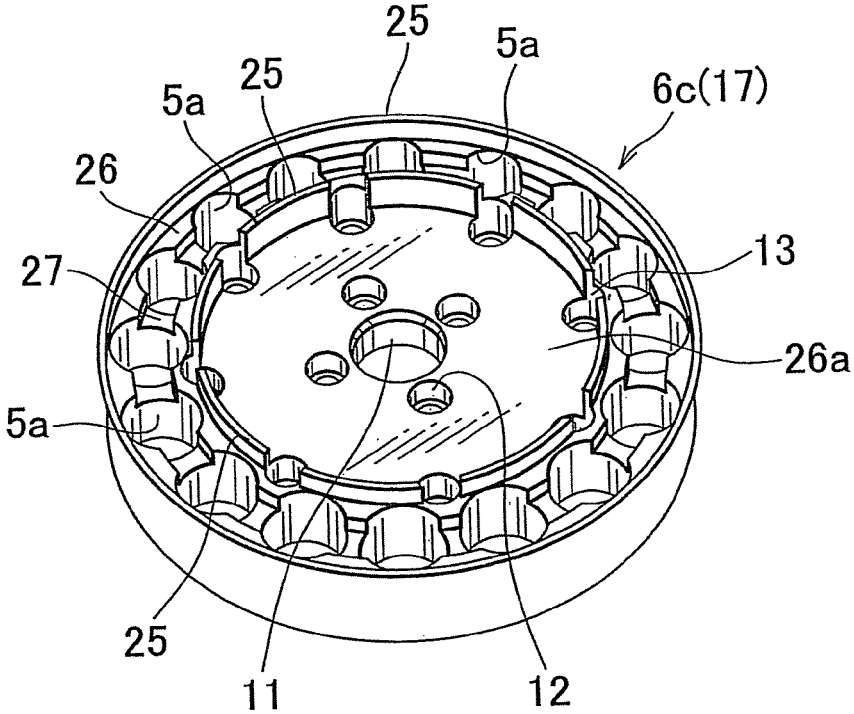
FIG. 5 is a perspective view showing a third modified example of the suppression portion employed in the polishing apparatus according to the first embodiment of the invention.

Next, a suppression portion 17 according to a third modified example of the first embodiment will be described on the basis of FIGS. 1 and 5. The suppression portion 17 according to this modified example includes a support plate 6*c* provided with a plurality of through holes 5*a* into which columnar, polishing brushes 3 are inserted, for adjusting the bristle length of the polishing brushes 3 extending respectively from the through holes 5*a* and suppressing splaying of the polishing brushes 3, and wall portions 25 that stand upright from one side face of the support plate 6*c* on the left and right sides of the through holes 5*a* in the advancement direction of the polishing brush 3. The through holes 5*a* are respectively formed such that the height of an inner wall surface thereof on the left and right sides of the advancement direction of the polishing brush 3 is greater than the height of the inner wall surface on the front and rear sides of the advancement direction.

More specifically, first, an outer peripheral site 26 of the support plate 6*c* in which the through holes 5*a* are formed is caused to project slightly to the metal ring 2 side, and in the outer peripheral site 26, groove portions 27 having a substantially rectangular diametrical direction cross-section are formed respectively in the wall portions between adjacent through holes 5*a*, 5*a*. As a result, the through holes 5*a* are formed respectively such that the inner wall surface height thereof on the left and right sides of the advancement direction of the polishing brush 3 is greater than the inner wall surface height on the front and rear sides of the advancement direction. Further, the will portions 25 respectively stand upright on the left and right sides of the advancement direction of the polishing brush 3 such that one side face of each wall portion 25 forms a continuation of the inner wall surface of the through holes 5*a* on the left and right sides of the advancement direction. Note that the wall portion 25 on the inside of the through holes 5*a* extends in a discontinuous arc shape to avoid the insertion holes 13 for fixing the guide rods. The wall portion 25 on the outside of the through holes 5*a*, on the other hand, extends in a circular shape around an outer peripheral edge of the support plate 6*c*. The suppression portion 17 according to the third modified example is a combination of the suppression portion 15 according to the first embodiment and the suppression portion 16 according to the second modified example. Note that in the third modified example, a difference between a tip end portion of each wall portion 25 and a lowest end portion of the inner wall surface of each through hole 5*a* (a bottom portion of the groove portion 27) is set at approximately 2 mm to 5 mm.

The actions of the polishing apparatus 1 employing the suppression portion 17 according to the third modified example are substantially identical to the actions of the polishing apparatus 1 employing the suppression portions 15 and 16 according to the first embodiment and the first and second modified examples, apart from a slight difference in a restraining force applied to bristle groups on the left and right sides of the advancement direction of the polishing brush 3.

Figure 6:
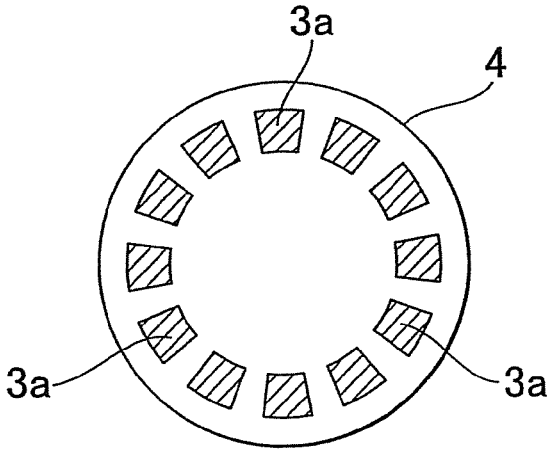
FIG. 6 is a plan view showing a fourth modified example of the suppression portion employed in the polishing apparatus according to the first embodiment of the invention.
Figure 7:
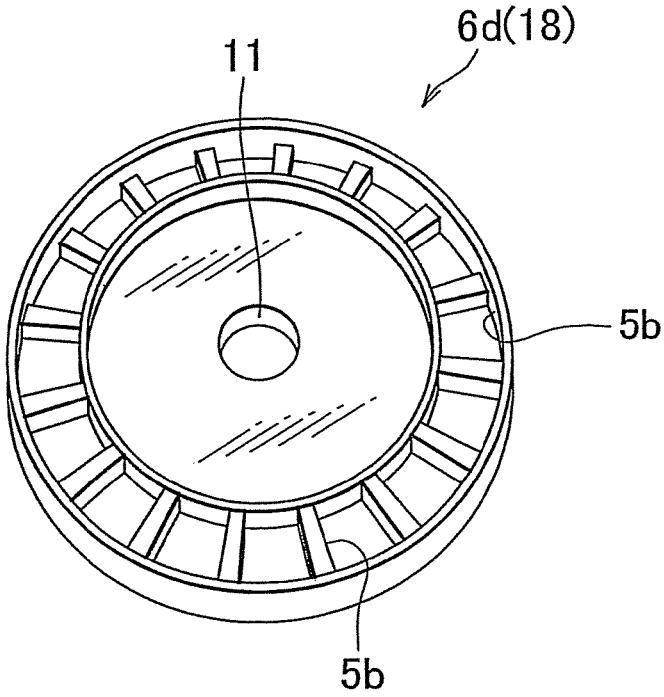
FIG. 7 is a perspective view of a support plate when the suppression portion shown in FIG. 6 is employed.

Next, a polishing brush 3*a* and a suppression portion 18 according to a fourth modified example will be described on the basis of FIGS. 6 and 7. In the fourth modified example, the polishing brushes 3*a* have a substantially rectangular orthoaxial cross-section and are disposed in the holding plate 4 such that a thickness thereof in the advancement direction of the polishing brush 3*a* is substantially constant. More specifically, the polishing brushes 3*a* are disposed at predetermined intervals in a circumferential direction of the outer peripheral portion of the holding plate 4 and oriented such that the thickness thereof is substantially constant in the circumferential direction. FIG. 7 shows a support plate 6*d* employing the suppression portion 18 according to the fourth modified example. In the support plate 6*d*, a plurality of substantially rectangular through holes 5*b*, into which the polishing brushes 3*a* having a substantially rectangular orthoaxial cross-section are respectively inserted, are formed at predetermined intervals in the circumferential direction. Note that the guide rod insertion holes 13 and the elevator rod insertion hole 12 provided in the support plates 6*a*, 6*b* and 6*c* shown in FIGS. 2 to 5 have been omitted from the illustration of the support plate 6*d* shown in FIG. 7. The suppression portion 15, 16, or 17 according to the first to third modified examples described above may be applied to the suppression portion 18 according to the fourth modified example.

Next, a polishing apparatus 1*a* according to a second embodiment of the invention will be described on the basis of FIGS. 1 and 8. The polishing apparatus 1*a* according to the second embodiment includes a ring rotation device (not shown) that holds the metal ring 2 and rotates the metal ring 2 in a circumferential direction, columnar polishing brushes 3*b* that polish an end edge 22 of the metal ring 2 by bringing bristle tips thereof into contact with the end edge 22 as the bristle tips pass the end edge 22, a holding plate 4 on which a plurality of the polishing brushes 3*b* stand upright at intervals in a circumferential direction and which holds one end portion of each polishing brush 3*b*, and a support plate 6 having through holes 5 into which the polishing brushes 3*b* are respectively inserted, for adjusting a bristle length of the polishing brushes 3*b* extending from the through holes 5 and suppressing splaying of the polishing brushes 3*b*. Hence, the polishing apparatus 1*a* is provided with two polishing brush units 10*b*, each of which is constituted by the polishing brushes 3*b*, the holding plate 4, and the support plate 6, and these two polishing brush units 10*b* are disposed in close proximity. Note that the ring rotation device, the holding plate 4, and the support plate 6 are identical to their counterparts in the related art field, and hence description thereof has been omitted.

Figure 8:
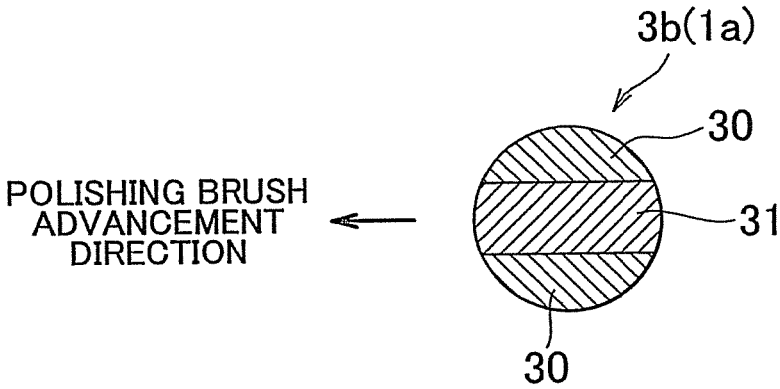
FIG. 8 is a view showing an orthoaxial cross-section of a polishing brush employed in a polishing apparatus according to a second embodiment of the invention.

As shown in FIG. 8, the rigidity of the polishing brush 3*b* differs according to region on the orthoaxial cross-section thereof such that the rigidity of bristle groups 30, 30 on the left and right sides of the advancement direction of the polishing brush 3*b* is greater than the rigidity of a substantially central bristle group 31. The regional rigidity of the polishing brush 3*b* may be set by applying different materials to the bristle groups 30 on the left and right sides of the advancement direction of the polishing brush 3*b* and the bristle group 31 substantially in the center of the advancement direction, for example. Alternatively, the regional rigidity of the polishing brush 3*b* may be set by forming the bristle groups 30 on the left and right sides of the advancement direction of the polishing brush 3*b* from bristle units having a large diameter and forming the bristle group 31 substantially in the center of the advancement direction from bristle units having a small diameter, for example. Further, the regional rigidity of the polishing brush 3*b* may be set by applying different orthoaxial sectional shapes to the bristle units of the bristle groups 30 on the left and right sides of the advancement direction of the polishing brush 3*b* and the bristle units of the bristle group 31 substantially in the center of the advancement direction, for example.

Figure 9:
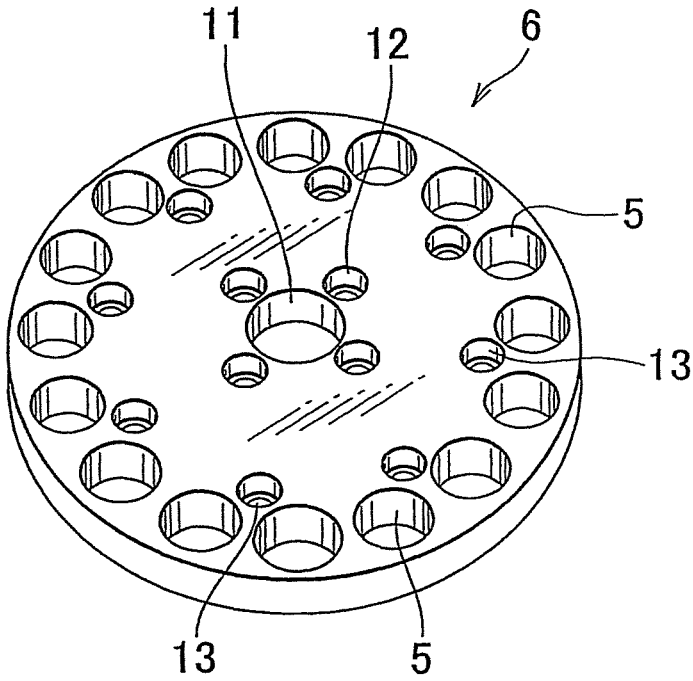
FIG. 9 RELATED ART
FIG. 9 is a perspective view showing a support plate of a related art field.
Figure 10:
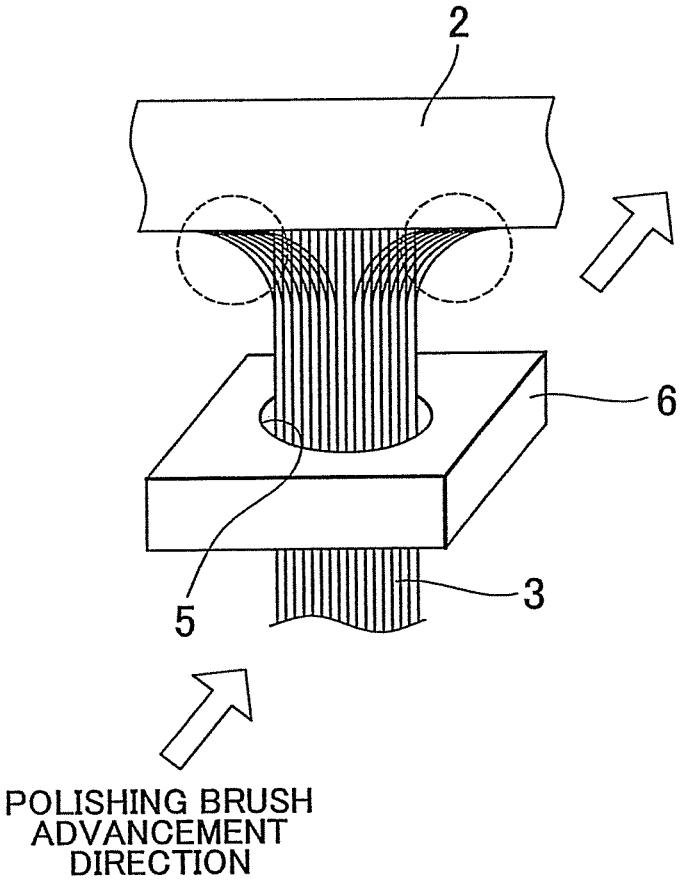
FIG. 10 RELATED ART
FIG. 10 is a view seen from the rear of an advancement direction when an end edge of a metal ring is polished by the bristle tips of a polishing brush.
Figure 11A:
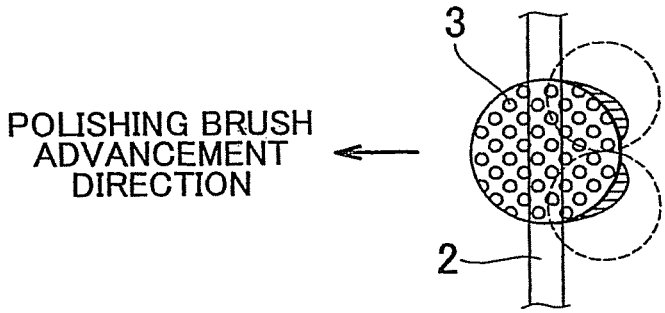
FIG. 11A RELATED ART
FIG. 11A is a view seen from a metal ring side and FIG. 11B is a view seen from the side when an end edge of a metal ring is polished by the bristle tips of a polishing brush.
Figure 11B:
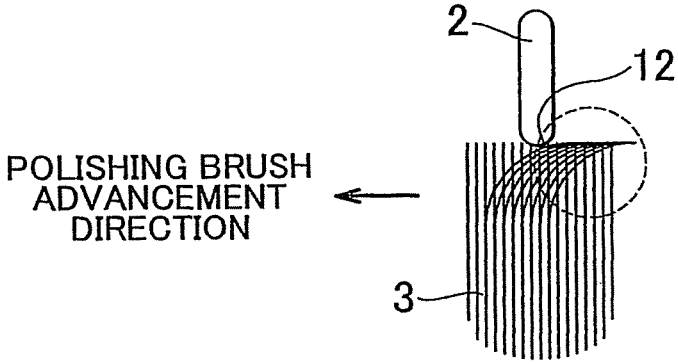
FIG. 11B RELATED ART

Note that the methods described above for setting the regional rigidity of the polishing brush 3*b* may be employed singly or in combination. Further, in the polishing apparatus 1*a* according to the second embodiment, the support plate 6 shown in FIG. 1 or 9 is employed, but as long as the desired restraining force can be provided in the polishing brushes 3*b*, the support plate 6 does not necessarily have to be employed. Furthermore, in the polishing apparatus 1*a* according to the second embodiment, the support plate 6 shown in FIG. 1 or 9 is employed, but instead of the support plate 6, the suppression portions 15 to 18 employed in the polishing apparatus 1 according to the first embodiment may be employed.

The actions of the polishing apparatus 1*a* according to the second embodiment are substantially identical to the actions of the polishing apparatus 1 according to the first embodiment, apart from a slight difference in the restraining force applied to the respective bristle groups (see reference numeral 30 in FIG. 8) on the left and right sides of the advancement direction of the polishing brushes 3, 3*a*, 3*b*.

As described above, first, the polishing apparatus 1 according to the first embodiment of the invention includes the suppression portion 15 to 18 for suppressing deformation of the bristle tips of the polishing brush 3, 3*a*, and therefore, when the end edge 22 of the metal ring 2 is polished, diagonally rearward splaying of the bristle tips of the polishing brush 3, 3*a* from the left and right sides of the advancement direction is restricted, whereby deformation of the bristle tips of the polishing brush 3, 3*a* is suppressed. Further, in the polishing apparatus 1*a* according to the second embodiment of the invention, the rigidity of the polishing brush 3*b* differs according to region on the orthoaxial cross-section thereof such that the rigidity of the bristle groups 30, 30 on the left and right sides of the advancement direction of the polishing brush 3*b* is greater than the rigidity of the substantially central bristle group 31, and therefore, when the end edge 22 of the metal ring 2 is polished, diagonally rearward splaying of the bristle tips of the polishing brush 3*b* from the left and right sides of the advancement direction is restricted, whereby deformation of the bristle tips of the polishing brush 3*b* is suppressed. As a result, partial wear of the polishing brush 3, 3*a*, 3*b* is suppressed, leading to an improvement in the durability of the polishing brush 3, 3*a*, 3*b*. Moreover, the contact area between the bristle tips of the polishing brush 3, 3*a*, 3*b* and the end edge 22 of the metal ring 2 does not vary from the initial polishing stage, and therefore the end edge 22 of the metal ring 2 can be polished with a high degree of precision.

Note that in the polishing apparatuses 1, 1*a* according to the first and second embodiments of the invention, a slight difference occurs in the restraining force applied to the bristle groups 30 on the left and right sides of the advancement direction of the polishing brush 3, 3*a*, 3*b*, and therefore an embodiment having the desired restraining force in the bristle groups 30 on the left and right sides of the advancement direction of the polishing brush 3, 3*a*, 3*b* should be selected in consideration of the component to be polished, the capacity of the polishing apparatus, installation costs, and so on.

Further, the polishing apparatuses 1, 1*a* according to the first and second embodiments of the invention are employed mainly to polish the end edge 22 of the metal ring 2 of a power transmission belt employed in a CVT, but may be used widely on polishing subject components having a sharp end edge 22 that requires polishing.

The invention claimed is:

1. A polishing apparatus for polishing an end edge of a work piece by bringing a bristle tip of a polishing brush into contact with the end edge of the work piece as the bristle tip passes the end edge of the work piece, comprising:

a support plate having a through hole into which the polishing brush is inserted; and a suppression portion that is provided at the support plate and suppresses a deformation of the bristle tip of the polishing brush when the work piece is polished, wherein the suppression portion is constituted by wall portions that stand upright respectively from one side face of the support plate on left and right sides of the through hole in the advancement direction of the polishing brush, and wherein in the suppression portion, the through hole is formed such that a height of an inner wall surface on the left and right sides of the advancement direction of the polishing brush is greater than the height of the inner wall surface on the front and rear sides of the advancement direction of the polishing brush.

2. The polishing apparatus according to claim 1, wherein:

the polishing brush has a substantially rectangular orthoaxial cross-section; and the polishing brush is disposed such that a thickness thereof in the advancement direction is substantially constant.

3. The polishing apparatus according to claim 2, wherein the through hole of the support plate is a substantially rectangular thorough hole.

4. The polishing apparatus according to claim 1, wherein the work piece is a metal ring of a power transmission belt employed in a continuously variable transmission.

5. The polishing apparatus according to claim 1, wherein the suppression portion is constituted by the thickness of the support plate.

6. The polishing apparatus according to claim 1 wherein the suppression portion is constituted with the support plate of which an outer peripheral site is thicker than the thickness of a central site.

7. The polishing apparatus for polishing an edge of a work piece by bringing a bristle tip of a polishing brush into contact with the end edge of the work piece as the bristle tip passes the end edge of the work piece, comprising:

a support plate having a through hole into which the polishing brush is inserted; and a suppression portion that is provided at the support plate and suppresses a deformation of the bristle tip of the polishing brush when the work piece is polished, wherein, in the suppression portion, the through hole is formed such that a height of an inner wall surface on the left and right sides of the advancement direction of the polishing brush is greater than the height of the inner wall surface on the front and rear sides of the advancement direction of the polishing brush.

8. The polishing apparatus according to claim 7, wherein:

the polishing brush has a substantial rectangular orthoaxial cross-section; and the polishing brush is disposed such that a thickness thereof in the advancement direction is substantially constant.

9. The polishing apparatus according to claim 8, wherein the through hole of the support plate is a substantially rectangular thorough hole.

10. The polishing apparatus according to claim 7, wherein the work piece is a metal ring of a power transmission belt employed in a continuously variable transmission.

11. The polishing apparatus according to claim 7, wherein the suppression portion is constituted by the thickness of the support plate.

12. The polishing apparatus according to claim 7, wherein the suppression portion is constituted with the support plate of which an outer peripheral site is thicker than the thickness of a central site.

* * * * *